US008505913B2

(12) United States Patent
Nishii et al.

(10) Patent No.: US 8,505,913 B2
(45) Date of Patent: Aug. 13, 2013

(54) SHEET TRANSPORT MECHANISM AND ELECTROPHOTOGRAPHIC IMAGE FORMING APPARATUS INCORPORATING SAME

(75) Inventors: Toshikane Nishii, Ikeda (JP); Hiroshi Fujiwara, Ikeda (JP); Tomoyoshi Yamazaki, Minoh (JP); Haruyuki Honda, Minoh (JP); Kazuyoshi Kondo, Toyonaka (JP); Mizuna Tanaka, Ikeda (JP)

(73) Assignee: Ricoh Company, Limited, Tokyo (JP)

( * ) Notice: Subject to any disclaimer, the term of this patent is extended or adjusted under 35 U.S.C. 154(b) by 168 days.

(21) Appl. No.: 12/801,493

(22) Filed: Jun. 11, 2010

(65) Prior Publication Data

US 2010/0314827 A1 Dec. 16, 2010

(30) Foreign Application Priority Data

Jun. 11, 2009 (JP) ..... 2009-140423
Mar. 17, 2010 (JP) ..... 2010-060362

(51) Int. Cl.
*B65H 5/00* (2006.01)

(52) U.S. Cl.
USPC ..... 271/264

(58) Field of Classification Search
USPC ..... 271/264, 258.01, 265.01, 301, 303, 271/9.01, 9.11, 9.13; 399/381, 400
See application file for complete search history.

(56) References Cited

U.S. PATENT DOCUMENTS

| | | | | |
|---|---|---|---|---|
| 6,926,272 | B2 * | 8/2005 | Carter et al. | 271/258.01 |
| 2004/0251602 | A1 * | 12/2004 | Ruhe et al. | 271/167 |
| 2008/0224385 | A1 | 9/2008 | Takahira et al. | |

FOREIGN PATENT DOCUMENTS

| | | | |
|---|---|---|---|
| JP | 3351986 | | 12/1998 |
| JP | 3434206 | | 1/2000 |
| JP | 2000-219382 | | 8/2000 |
| JP | 2003-192180 | * | 7/2003 |
| JP | 2005-225586 | | 8/2005 |
| JP | 2006-193317 | * | 7/2006 |

OTHER PUBLICATIONS

English translation of Detailed Description of JP2003-192180.*
English translation of Detailed Description of JP2006-193317.*
Abstract of Japan Publication No. JP 10-316273 published on Dec. 2, 1998.
Abstract of Japan Publication No. JP 2000-007184 published on Jan. 11, 2000.

* cited by examiner

*Primary Examiner* — Thomas Morrison
(74) *Attorney, Agent, or Firm* — Harness, Dickey & Pierce

(57) ABSTRACT

A sheet transport mechanism that can be incorporated in an image forming apparatus includes a first sheet transport member, a second sheet transport member disposed downstream from the first sheet transport member in a sheet transport direction, a sheet transport path defined by and curved between the first and second sheet transport members and including a downstream section recessed from an upstream section in the sheet transport direction, and a contact member disposed at the downstream section and including a first contact portion to which the leading edge of a sheet contacts to move the contact member in a direction to recess from the sheet transport path and a second contact portion connected to the first contact portion to advance toward the sheet transport path at a position upstream from the first contact portion in the sheet transport direction to contact the surface of the sheet.

16 Claims, 11 Drawing Sheets

SHEET TRANSPORT MECHANISM AND ELECTROPHOTOGRAPHIC IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2009-140423, filed on Jun. 11, 2009 in the Japan Patent Office, and Japanese Patent Application No. 2010-060362, filed on Mar. 17, 2010 in the Japan Patent Office, which are hereby incorporated by reference herein in their entirety.

BACKGROUND OF THE INVENTION

1. Field of the Invention

Exemplary embodiments of the present invention relate to a sheet transport mechanism that feeds and conveys a sheet in a predetermined direction and an image forming apparatus incorporating the above-described sheet transport mechanism.

2. Discussion of the Related Art

In some related-art image forming apparatuses, in a sheet transport path along which sheets of recording media are conveyed, the leading edge of any given sheet tends to get snagged or caught at a boundary between adjacent units along the sheet transport path. To avoid this problem, the sheet transport path is typically given a recessed portion or step at the boundary. Specifically, a downstream unit, that is, the unit provided downstream in a sheet transport direction of the sheet transport path, is recessed from the upstream unit, that is, the unit provided upstream in the sheet transport direction of the sheet transport path.

As a further aid to the smooth conveyance of the sheets, for example, at a meeting point where two original sheet transport paths meet, the width of a merged sheet transport path downstream from the meeting point is greater than the widths of each of the two original sheet transport paths upstream from the meeting point. This structure of the sheet transport path can convey a sheet smoothly from the two original sheet transport paths via the meeting point toward the downstream direction from the meeting point.

Positions of units and mechanisms that constitute an image forming apparatus, such as a sheet transport mechanism, an image forming mechanism, a transfer unit, and a fixing unit can be variously arranged depending on the desired functional purposes. Consequently, sheet transport paths may be curved or bent as needed, and therefore a sheet may also be curved or bent when passing through a curved portion of the sheet transport path. However, while traveling in the sheet transport path that is curved or bent, the restorative force of the sheet tends to bring the curved sheet back to its original flat shape. As a result, the trailing edge of the sheet strikes or flaps against a recessed downstream unit or portion when passing the stepped boundary in the sheet transport path, which produces a flapping noise with the trailing edge of the sheet (hereinafter, also referred to as "trailing edge flapping noise").

As previously noted, if a sheet transport path having the meeting point at which two or more sheet transport paths meet is curved or bent, the width of the merged sheet transport path downstream from the meeting point is greater than the widths of each of the two sheet transport paths upstream from the meeting point. Therefore, the sheet transport path includes the different levels or steps in the vicinity of the meeting point, which can also produce the trailing edge flapping noise.

To eliminate such flapping noise, one approach, for example, involves a unit that includes a seam or bump between adjacent members that constitute the unit that is configured such that a member disposed downstream from the seam includes a portion to lift up the trailing edge of a sheet from the member so as to prevent production of flapping noise. However, this configuration cannot raise the trailing edge of the sheet in space reliably without increasing a relative angle at a sheet entrance path when the leading edge of the sheet enters a downstream guide member therefrom. It is then likely that a sheet transport load from the downstream guide member increases, resulting in a paper jam. In addition, a sheet having greater rigidity can exert a larger restorative force. The foregoing arrangement cannot reduce flapping noise of the rigid sheet.

Another approach involves an image forming apparatus that includes guide members, with a seam formed between the guide members angled in a width direction of the guide members. This structure can cause the trailing edge of a sheet to hit different parts of the seam at different times. Even though this configuration can reduce the occurrence of flapping noise, the flapping noise can still occur. Further, if the sheet transport path is constricted due to a cramped layout design, an angle of the seam sufficient to prevent the flapping noise cannot be obtained.

Yet another approach involves a mechanism that includes a movable guide member at a convergence part that controls the configuration of two curved guide paths. That is, when a sheet enters from one of the sheet entrance paths, the movable guide member is maintained to eliminate a step formed by a first curved guide of the two paths. However, this configuration requires a sequence reflecting method performed by a control unit and a driving member to drive the rotary member are needed, which has large drawbacks and demerits in costs.

SUMMARY OF THE INVENTION

Example aspects of the present invention have been made in view of the above-described circumstances.

Example aspects of the present patent application provide a novel sheet transport mechanism that can prevent the occurrence of flapping and its associated noise.

Other example aspects of the present invention provide an electrophotographic image forming apparatus that can include the above-described sheet transport mechanism.

In one embodiment, a sheet transport mechanism includes a first sheet transport member, a second sheet transport member, a sheet transport path, and a contact member. The first sheet transport member feeds and conveys a sheet. The second sheet transport member is disposed downstream from the first sheet transport member to forward the sheet in a sheet transport direction. The first sheet transport member and the second sheet transport member define the curved sheet transport path, which includes an upstream section and a downstream section recessed from the upstream section in the sheet transport direction. The contact member is disposed at the downstream section to contact the sheet and includes a first contact portion, which the leading edge of the sheet contacts to move in a direction to retreat from the sheet transport path, and a second contact portion connected to the first contact portion to advance toward the sheet transport path at a position upstream from the first contact portion to contact the surface of the sheet.

The sheet transport path may be divided into the upstream section and the downstream section at a parting point in a direction intersecting the sheet transport direction. The downstream section from the parting point may be more recessed from the sheet transport path than the upstream section from the parting point.

The sheet transport path may include a meeting point to meet with at least one other sheet transport path. The downstream section from the meeting point may be more recessed from the sheet transport path than the upstream section from the meeting point.

The contact member may be disposed at a position further recessed from the sheet transport path than the downstream section of the sheet transport path. The sheet transport mechanism may further include a point of rotation disposed upstream from the first contact portion and downstream from the second contact portion in the sheet transport direction, about which the first contact portion and the second contact portion rotate.

When the first contact portion contacts the leading edge of the sheet, as the first contact portion rotates about the point of rotation toward the downstream section in the sheet transport direction, the second contact portion may rotate about the point of rotation toward the downstream section in the sheet transport direction and advance toward the sheet transport path to contact a surface of the sheet.

The contact member may include a substantially L-shaped curved portion. The point of rotation may be arranged at the substantially L-shaped curved portion.

An angle formed between the first contact portion and the second contact portion with the point of rotation therebetween may be in a range of 90 degrees$\leqq\theta<$180 degrees.

The contact member may have a structure in which a straight line joining the first contact portion and the point of rotation is longer than a straight line joining the second contact portion and the point of rotation.

The above-described sheet transport mechanism may further include a biasing member to urge the contact member to maintain the second contact portion at a position that is recessed from the sheet transport path.

The weight thereof with a torque for rotating the contact member about the point of rotation may maintain the contact member at a position that is recessed from the sheet transport path.

The second contact portion of the contact member may be retreat from the sheet transport path by rotating about the point of rotation by the weight of the contact member.

The contact member may have a coefficient of friction of at least the first contact portion and the second contact portion smaller than a coefficient of friction of the surface of the sheet transport path.

The contact member may further include at least one roller that rotates in a direction of at least one of the first contact portion and the second contact portion, disposed on at least one of the first contact portion and the second contact portion.

The above-described sheet transport mechanism may further include a detector to detect changes in position of the contact member.

The contact member may be constituted as multiple contact sub-members arranged in a direction perpendicular to the sheet transport direction.

At least one of the multiple contact sub-members may be disposed at a position at which a minimum-size target sheet contacts at least one of the multiple contact sub-members.

The contact member may be disposed at substantially a centerline of the sheet transport path in a direction perpendicular to the sheet transport direction.

Alternatively, the contact member may be disposed to one side of the centerline of the sheet transport path in a direction perpendicular to the sheet transport direction.

In one embodiment, an image forming apparatus includes an image forming mechanism to form an image and the above-described sheet transport mechanism.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
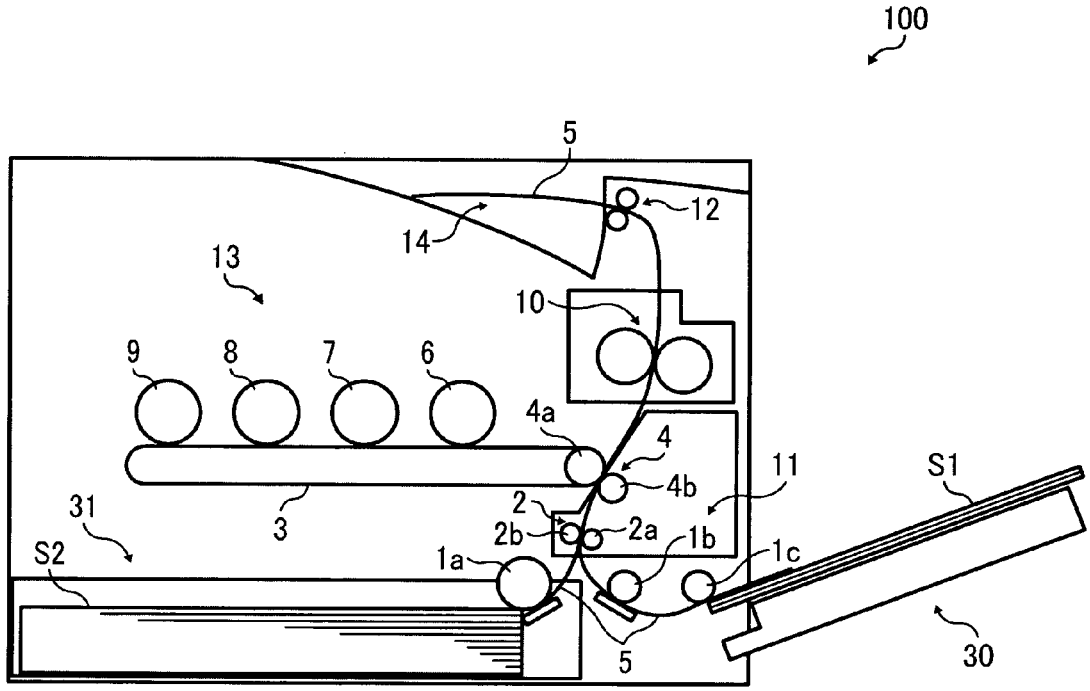
FIG. 1 is a cross-sectional view of an image forming apparatus according to the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Embodiments described below are not limited to those illustrated in the drawings but can be also applied to various types of sheet transport mechanisms and image forming apparatuses.

First Embodiment

FIG. 1 illustrates a cross-sectional view of an image forming apparatus 100 according to an embodiment (hereinafter referred to as the first embodiment) of the present patent application.

The image forming apparatus 100 includes sheet feeding rollers 1*a*, 1*b*, and 1*c*, a pair of registration rollers 2, an intermediate transfer belt 3, a pair of transfer rollers 4, photoconductors 6, 7, 8, and 9, a pair of fixing rollers 10, a pair of sheet discharging rollers 12, a discharged sheet stacker 14, sheet containers 30 and 31, and a sheet transport path 5, with a sheet transport direction indicated by arrow "X". The sheet feeding rollers 1*a*, 1*b*, and 1*c*, the pair of registration rollers 2, and the sheet transport path 5 basically form a sheet transport mechanism 11. The photoconductors 6, 7, 8, and 9 and other image forming components, not illustrated, which are disposed around each of the photoconductors 6, 7, 8, and 9 basically form an image forming mechanism 13.

The sheet feeding rollers 1*a*, 1*b*, and 1*c* serve as a first sheet transport member. The sheet feeding roller 1*a* is disposed at one end of the sheet container 31, and the sheet feeding rollers 1*b* and 1*c* are disposed in a vicinity of the sheet container 30. The sheet container 30 accommodates a stack of sheets S1 thereon and the sheet container 31 accommodates a stack of sheets S2 therein. A topmost sheet of the stack of sheets S1 is separated from the other sheets thereof by the sheet feeding roller 1*c* and a topmost sheet of the stack of sheets S2 is separated from the other sheets thereof by the sheet feeding roller 1*a*. The separate sheet is fed and conveyed through the sheet transport path 5 to a downstream side of the sheet transport direction X.

The pair of registration rollers 2 that includes a drive roller 2*a* and a driven roller 2*b* and serves as a second sheet transport member. The sheet passes between the drive roller 2*a* and the driven roller 2*b* and reaches the pair of transfer rollers 4 that includes a drive roller 4*a* and a driven roller 4*b*.

Toner images formed on the photoconductors 6 through 9 are transferred onto the intermediate transfer belt 3 to form a composite toner image thereon. When passing between the drive roller 4*a* and the driven roller 4*b* of the pair of transfer rollers 4, the composite toner image is transferred onto the sheet. The sheet with the composite toner image thereon is conveyed to the pair of fixing rollers 10 so that the composite toner image formed on the sheet is fixed to the sheet by application of heat and pressure. Then the pair of sheet discharging rollers 12 discharges the sheet with the composite toner image fixed thereto to the discharged sheet stacker 14.

Figure 2:
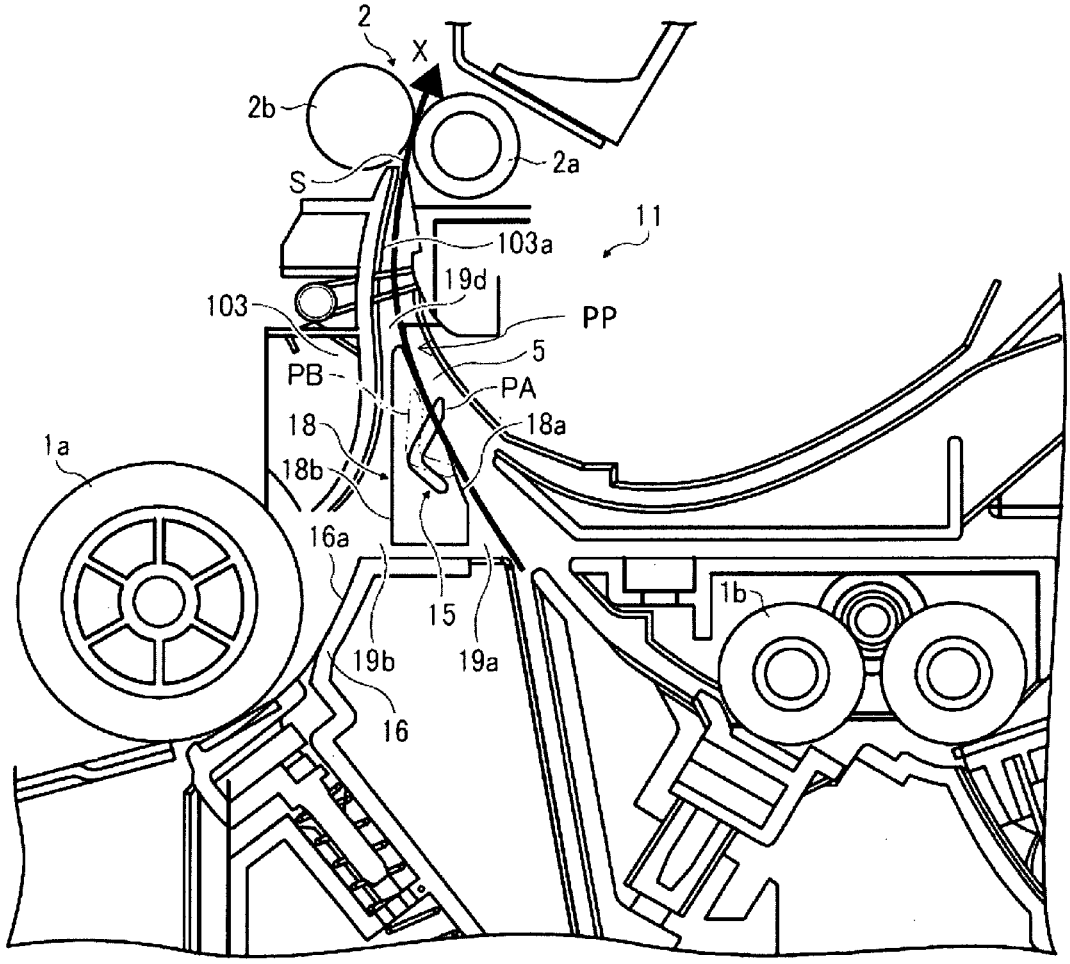
FIG. 2 is a cross-sectional view illustrating a guide member and a contact member provided in a sheet conveyance path of the image forming apparatus of FIG. 1, according to a first embodiment.

FIG. 2 illustrates an enlarged cross-sectional view of components provided in the sheet transport path 5 of the image forming apparatus 100 shown in FIG. 1.

As shown in FIG. 2, the image forming apparatus 100 further includes a guide member 18 that includes a contact member 15. The guide member 18 is disposed in the sheet transport path 5 to guide a sheet S to travel to its downstream side of the sheet transport direction.

Figure 3:
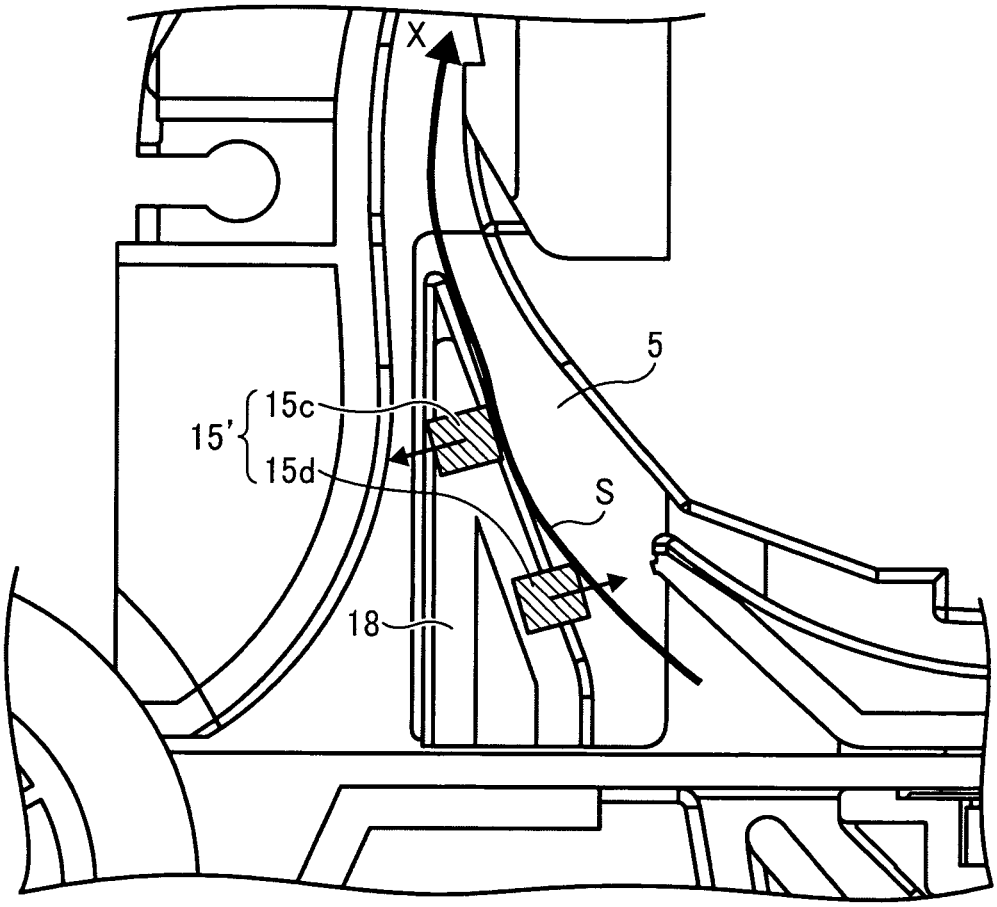
FIG. 3 is a perspective view of an example of a contact member formed by two portions.

The contact member 15 in FIG. 2 is constituted to include one member. However, the contact member 15 can also be constituted to include two or more sub-members. For example, as shown in FIG. 3, a contact member 15' includes two sub-members connected to each other, which are a first contact sub-member 15*c* and a second contact sub-member

15*d*. In this configuration, as the first contact sub-member 15*c* moves in a direction indicated by an arrow illustrated thereon in FIG. 3, the second contact sub-member 15*d* moves in a direction indicated by an arrow illustrated thereon in FIG. 3. This mechanism can effectively prevent the trailing edge of the sheet S from hitting the guide member 18 to cause a flapping noise. It should be noted, however, that the contact member 15 is preferably formed by one sub-member for transporting the sheet S by using the restorative force of the sheet S.

Figure 4:
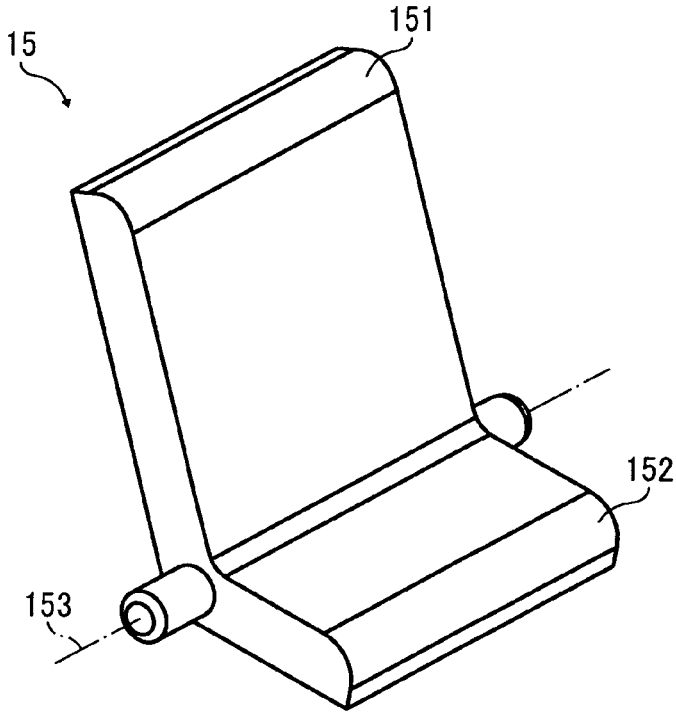
FIG. 4 is a perspective view of the contact member of FIG. 2.
Figure 5:
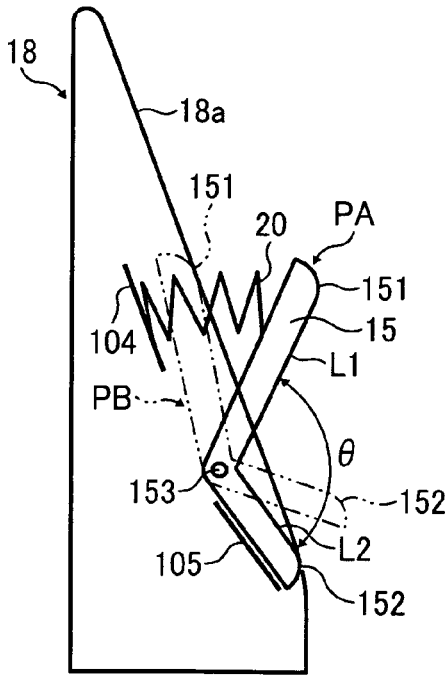
FIG. 5 is a diagram illustrating the guide member and the contact member of FIG. 2, according to the first embodiment.

FIG. 4 illustrates a perspective view of the contact member 15. The contact member 15 is bent in a substantially L-shape form in the configuration shown in FIG. 2 (for details, see FIG. 5), and includes a first contact portion 151 and a second contact portion 152 disposed upstream from the first contact portion 151 in the sheet transport direction X, and a rotation center 153. The contact member 15 is disposed at a position where the sheet transport path 5 is divided into an upstream section and a downstream section in the sheet transport direction X. When the sheet S has not reached the first contact portion 151 of the contact member 15 on a guiding face 18*a* of the guide member 18, the contact member 15 maintains in a position PA on the guiding face 18*a* of the guide member 18 as illustrated in a solid line in FIG. 2 (for details, see FIG. 5). Therefore, as shown in FIG. 5, when the sheet S reaches a downstream portion of the guiding face 18*a* of the guide member 18 in the sheet transport direction X, the leading edge of the sheet S contacts and pushes the contact member 15 with the curvature of the sheet transport path 5 and the rigidity of the sheet S. Consequently, as the contact portion 151 of the contact member 15 is pressed by the leading edge of the sheet S, the contact member 15 in the position PA as shown in FIG. 5 rotates about the rotation center 153, the second contact portion 152 of the contact member 15 advances toward the sheet transport path 5 to contact the sheet S with a repulsion as illustrated in FIG. 6B. By contacting the first contact portion 151 and the second contact portion 152, the sheet S that keeps its position along the guiding face 18*a* of the guide member 18 is lifted up in space from the guiding face 18*a*, and therefore the trailing edge of the sheet S can be conveyed without generating a flapping noise in a step 19*a* (illustrated in FIG. 2) that is formed in the sheet transport path 5 from the sheet containers 30 and 31. This movement of the contact member 15 can therefore prevent the occurrence of the flapping noise.

Figure 7:
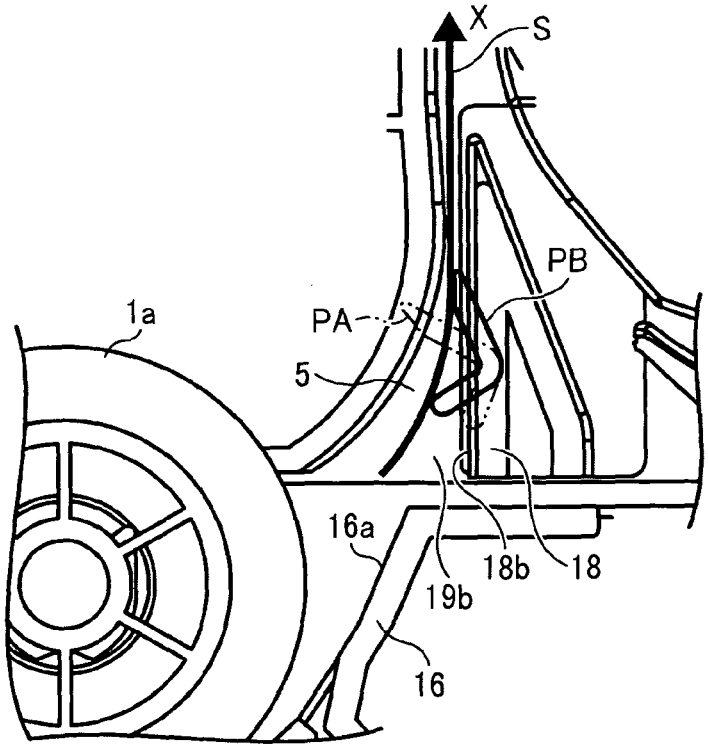
FIG. 7 is an enlarged view of the step provided in the sheet transport path shown in FIG. 2.

With the above-described mechanism, the occurrence of the flapping noise in a step 19*b* can be prevented by providing a guiding face 16*a* of a guide member 16 disposed upstream from the step 19*b* and defining the sheet transport path 5 after the sheet feeding roller 1*a* serving as the first sheet transport member and a guiding face 18*b* of the guide member 18 disposed downstream from the step 19*b* in the sheet transport direction X, as shown in FIG. 2 and FIG. 7 as an enlarged view of FIG. 2.

Figure 8:
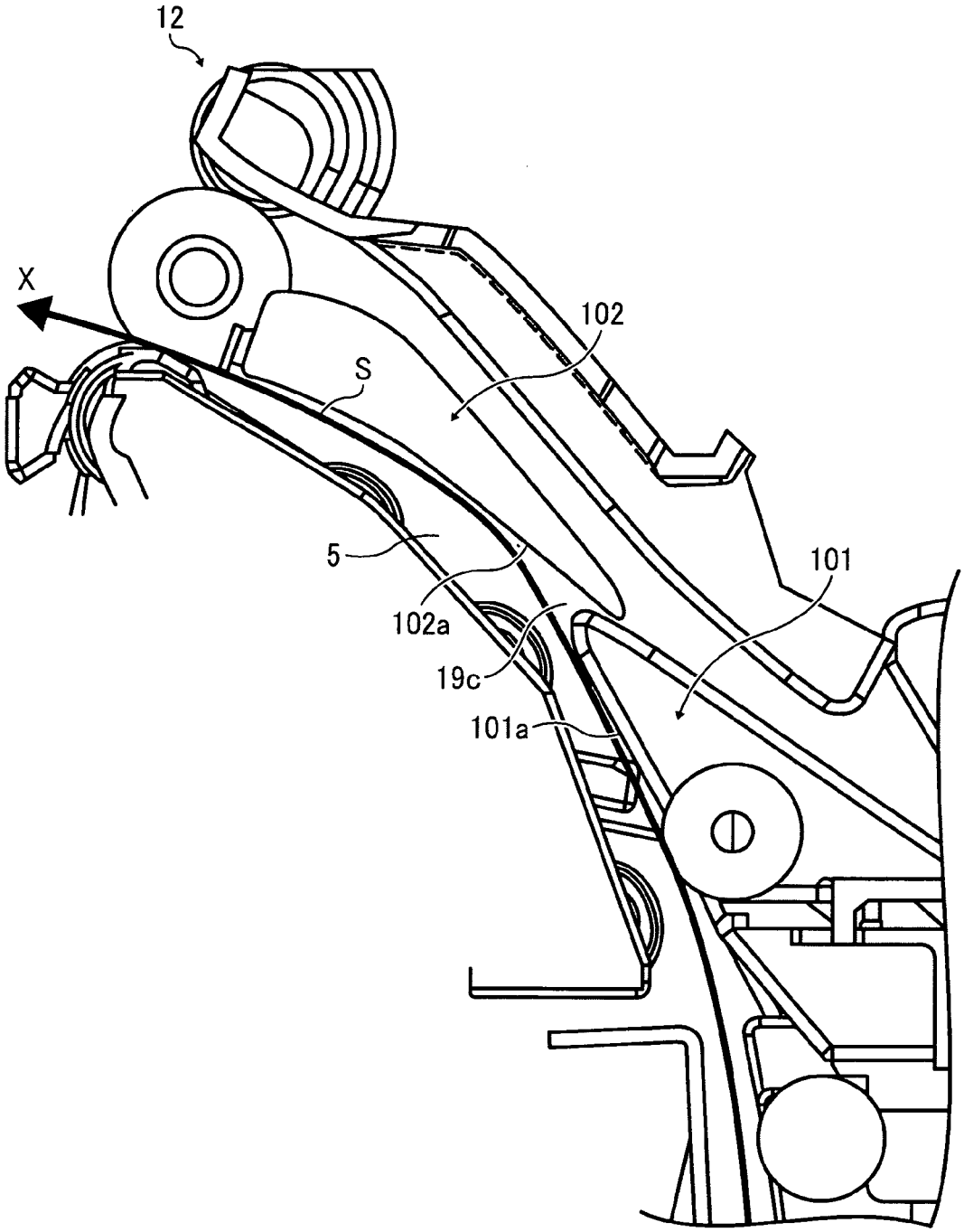
FIG. 8 is a diagram illustrating a sheet transport path extending beyond a pair of fixing rollers.

Further, the occurrence of the flapping noise in a step 19*c* can be prevented by providing a guiding face 101*a* of a guide member 101 disposed upstream from the step 19*c* and defining the sheet transport path 5 after the pair of fixing rollers 10 and a guiding face 102*a* of a guide member 102 disposed downstream from the step 19*c* in the sheet transport direction X, as shown in FIG. 8.

Figure 9:
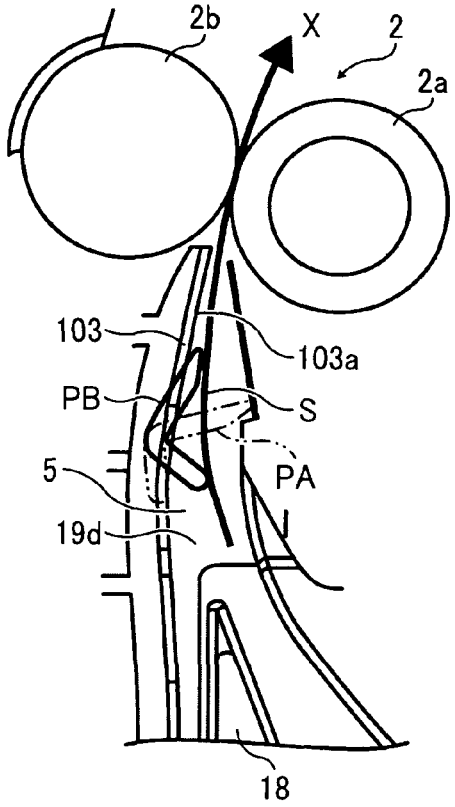
FIG. 9 is an enlarged view of the step provided in the sheet transport path shown in FIG. 2.

Further, the occurrence of the flapping noise in a step 19*d* can be prevented by providing the guide member 18 and a guiding face 103*a* of a guide member 103 disposed at a meeting point of the two sheet transport paths 5 defined by the sheet feeding rollers 1*a* and 1*b*, as shown in FIG. 2 and FIG. 9 as an enlarged view of FIG. 2.

Besides these steps in the sheet transport paths 5 and at the meeting point thereof, this application can be applied to any step formed where the sheet S travels in a curved transport path and a guiding face is arranged on the outside of the curved transport path.

Further, the contact member 15 provided on the guide member 18 can be disposed downstream from the step 19 with a distance in the sheet transport direction X. With this structure, even if the guide member 18 is movable with respect to a main body of the image forming apparatus 100, the sheet S can be conveyed smoothly and the occurrence of flapping noise can be prevented. However, for preventing the occurrence of the flapping noise caused by the sheet S at the step 19, it is more effective that the contact member 15 is disposed at a position closer to the step 19.

A detailed description is given of the contact member 15 having the above-described effectiveness, referring to FIGS. 4 through 6B and FIGS. 10A through 11B.

Figure 6A:
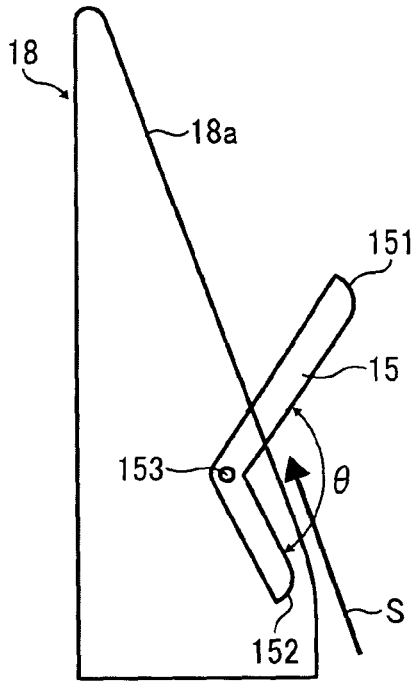
FIG. 6A is a diagram illustrating the contact member at a standby position, according to the first embodiment.
Figure 6B:
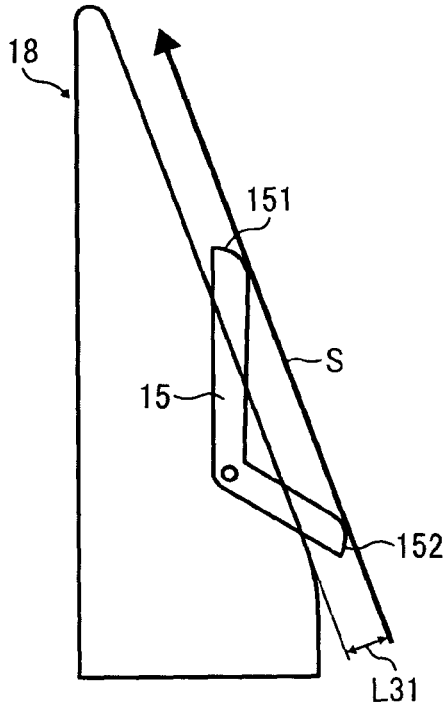
FIG. 6B is a diagram illustrating the contact member at a rotated position, according to the first embodiment.

The contact member 15 is arranged to maintain the position PA as a standby position before the sheet S is conveyed thereto, as illustrated in FIG. 6A. As a printing operation goes on, the sheet S is conveyed close to the contact member 151. When the leading edge of the sheet S strikes or hits the first contact portion 151 of the contact member 15, the contact member 15 rotates about the rotation center 153 in a counter-clockwise direction, raising the second contact portion 152 to contact the sheet S. Consequently, the sheet S is lifted up from the guiding face 18*a* and advances toward the sheet transport path 5.

As shown in FIG. 2, the downstream section of the sheet transport path 5 curves toward where the pair of registration rollers 2 is located, and is recessed from the upstream section where the sheet feeding rollers 1*a* through 1*c* are located. In other words, the sheet transport path 5 that includes the contact member 15 can smoothly convey the sheet S closer to the drive roller 2*a* of the pair of registration rollers 2 compared to the sheet transport path without the contact member 15. Accordingly, the sheet S is recessed from the guiding face 18*a*. At this time, to cause the contact member 15 to recess the sheet S from the guiding face 18, an interior angle θ that is formed by a wing line L1 of the contact member 15 that includes the first contact portion 151 and a wing line L2 of the contact member 15 that includes the second contact portion 152 is at least equal to or smaller than 180 degrees. Therefore, the contact member 15 is preferably formed in an L-shaped single member.

When the sheet S is conveyed in the sheet transport direction X with the leading edge thereof contacting the downstream section of the contact member 15 including the first contact portion 151, the interior angle θ of the contact member 15 is 120 degrees in FIGS. 5, 6A, and 6B. Alternatively, modified contact members can also be applied. For example, a contact member 15M1 illustrated in FIGS. 10A and 10B has the interior angle θ of 90 degrees and a contact member 15M2 illustrated in FIGS. 11A and 11B has the interior angle θ of 60 degrees.

Figure 10A:
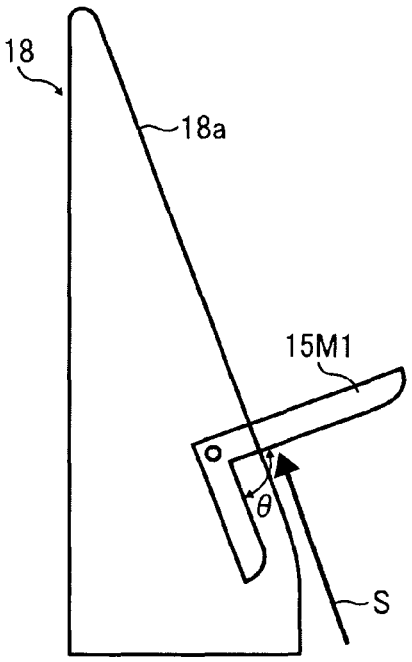
FIG. 10A is a diagram illustrating a modified contact member at a standby position, according to the first embodiment.
Figure 10B:
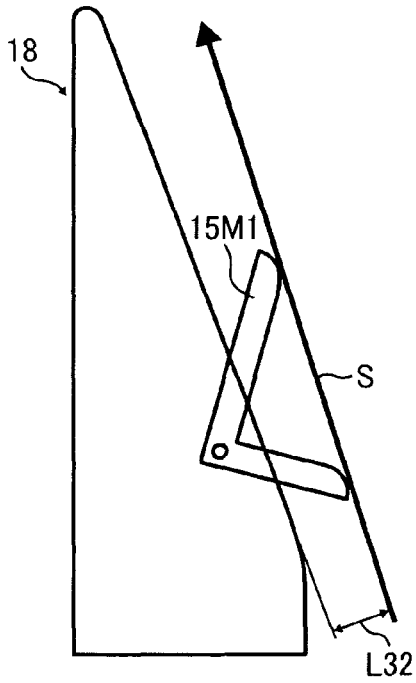
FIG. 10B is a diagram illustrating the modified contact member at a rotated position, according to the first embodiment.
Figure 11A:
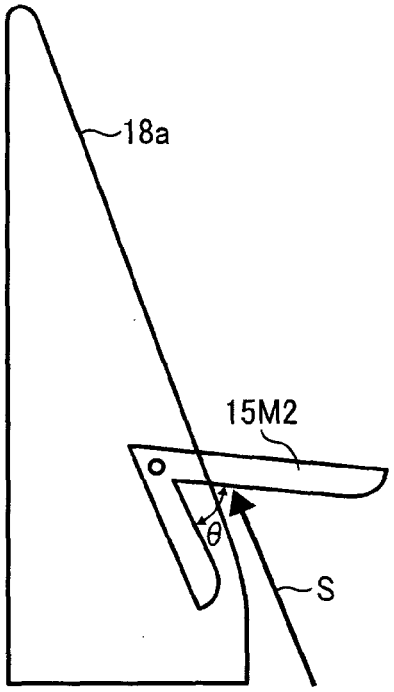
FIG. 11A is a diagram illustrating another modified contact member at a standby position.
Figure 11B:
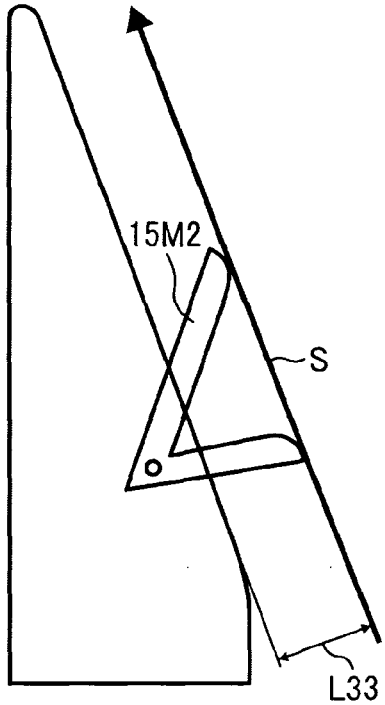
FIG. 11B is a diagram illustrating another modified contact member at a rotated position.

In these examples, a straight line connecting the first contact portion 151 and the rotation center 153 is longer than a straight line connecting the second contact portion 152 and the rotation center 153. A distance between the guiding face 18*a* and the sheet S depends on the interior angle θ of the contact member 15. For example, the contact member 15 having the interior angle θ of 120 degrees provides a distance L31 between the guiding face 18*a* and the sheet S as shown in FIG. 6B, the contact member 15M1 having the interior angle θ of 90 degrees provides a distance L32 as shown in FIG. 10B, and the contact member 15M2 having the interior angle θ of 60 degrees provides a distance L33 as shown in FIG. 11B. These distances satisfy the relation of "L31<L32<L33". To move the trailing edge of the sheet S away from the step, the interior angle θ should become closer to 0 degree. However, when the interior angle θ is too small, an angle formed by the wing line L1 and the guiding face 18*a* becomes 90 degrees or smaller, which is not appropriate. It is because, when the leading edge of the sheet S passes on the wing line L1 of the contact member 15, the wing line L1 including the first contact portion 151 can hinder the movement of the leading edge of the sheet S. Therefore, to transport the sheet S smoothly, even though it is not limited, it is preferable that the interior angle θ is equal to or greater than 90 degrees.

Further, when the interior angle θ becomes closer to 180 degrees, the distance between the surface of the sheet S and the guiding face 18*a* with the contact member 15 interposed therebetween decreases, which cannot eliminate the problem of the step 19. Therefore, it is preferable that an appropriate interior angle θ is set to obtain a height or distance between the guiding face 18*a* and the sheet S greater than the height of the step 19. When the guiding face 18*a* has sufficient space in the sheet transport direction X, the wing lines L1 and L2 of the contact member 15 can be longer, and therefore the interior angle θ of the contact member 15 can be greater.

Further, when regarding the rotation center 153 as a point of rotation, the first contact portion 151 as a point of effort, and the second contact portion 152 as a point of load, a mechanically-balanced relation of the wing lines L1 and L2 is preferably expressed as "L1>L2" to keep the trailing edge of the sheet S away from the guiding face 18*a* with a sufficient gap between the sheet S and the guiding face 18*a*. Accordingly, the trailing edge of the sheet S cannot strike the units or components in the step 19, and therefore the flapping noise may not occur.

As shown in FIG. 5, the image forming apparatus 100 may further include an elastic member 20 to serve as a biasing member. The elastic member 20 of FIG. 5 is provided between the guide member 18 and one side of the wing line L1 of the contact member 15, the side is opposed to a side on which the sheet S passes. The elastic member 20 can exert a force of repulsion to maintain the position of the contact member 15 to the position PA. That is, the contact member 15 would not change to the position PB reliably until the leading edge of the sheet S strikes the first contact portion 151 thereof. By so doing, the paper jam during sheet transport can be substantially prevented.

As shown in FIG. 5, the guide member 18 includes an attachment face 104 and an abutment face 105. One end of the elastic member 20 is fixedly attached to the attachment face 104 to urge the contact member 15 in a clockwise direction. The abutment face 105 is mounted on the guide member 18 to stop the further movement of the contact member 15. By providing the abutment face 105 on the guide member 18, the contact member 15 cannot rotate beyond a predetermined angle when the contact member 15 rotates in a clockwise direction. With this configuration, it can be determined that the contact member 15 is in the standby state, that is, the position PA before the sheet S strikes the first contact portion 151 of the contact member 15 and in the rotated state, that is, the position PB after the sheet S pushes the first contact portion 151 and rotates the contact member 15 about the rotation center 153 by the predetermined angle in a counterclockwise direction in the figure.

To reduce an increase in load of the sheet S while being conveyed, it is preferable that the biasing force of the elastic member 20 is as small as possible. Except that the amount of the biasing force of the elastic member 20 is not smaller than the load torque of the contact member 15 under rotation.

Examples of the elastic member 20 are helical compression spring, extension spring, and helical torsion coil spring; leaf spring; elastic resin portion formed by a part of the contact member; and buffer member such as damper having a restorative force.

Further; if a torque is generated using the own weight of the contact member 15, the contact member 15 can maintain in the position PA without using any biasing member, except while the sheet S is being conveyed. For example, when the center of gravity of the contact member 15 with respect to the rotation center 153 is positioned on the right-hand side in the figure, since the center of gravity of the contact member 15 generally tends to shift in the direction of gravity, that is, the downward direction with respect to the rotation center 153, the torque for the contact member 15 is constantly generated in the clockwise direction in FIG. 5. Therefore, the contact member 15 can maintain the position PA, except when the sheet S contacts the contact member 15 in the counterclockwise direction. Accordingly, the sheet transfer error or paper jam caused when the sheet S get snagged or jammed at the contact member 15 can be prevented. Furthermore, this configuration does not require any additional part to serve as a biasing member. Since the force of repulsion originally corresponds to the own weight of the contact member 15, a long-term effect can be expected.

To increase the torque of the contact member 15 under rotation, a distance or length of a segment between the rotation center 153 and the center of gravity may need to be long as possible. It is more preferable that the segment in the position PA becomes closer to a right angle with respect to the direction of gravity.

As described above, in the first embodiment, the coefficient of friction of the first contact portion 151 and the second contact portion 152 of the contact member 15 with respect to the sheet S is lower than the coefficient of friction of the guiding face 18*a* of the guide member 18 with respect to the sheet S, and therefore the sheet transfer load conventionally caused by friction due to a guiding face can be reduced. Consequently, the occurrence of paper jam due to frictional load can be prevented. For example, a Teflon (registered trade name) sheet having a small coefficient of friction can be provided at the first contact portion 151 and the second contact portion 152. Further, it is preferable that example materials of the contact member 15 have low coefficient of friction such as POM (polyacetal) as well as general resin materials such as PS, ABS, PC, etc., and general metal materials such as SECC and SUS.

Second Embodiment

Figure 12:
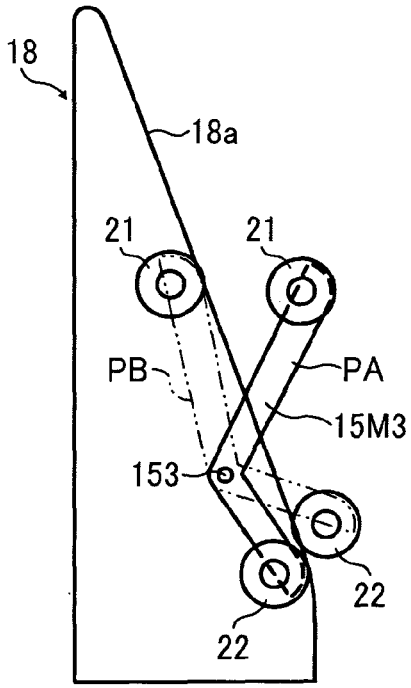
FIG. 12 is a diagram illustrating a contact member according to a second embodiment.

FIG. 12 illustrates a schematic configuration of the guiding member 18 to explain another embodiment, which is hereinafter referred to as a second embodiment.

As shown in FIG. 12, the guiding member 18 includes a contact member 15M2 with transfer rollers 21 and 22 attached to the first contact portion 151 and the second contact portion 152, respectively. With the transfer rollers 21 and 22, the frictional load with respect to the sheet S can be reduced, thereby preventing the occurrence of flapping noise and paper jam more effectively.

Further, since the transfer rollers 21 and 22 do not slide due to friction on the sheet S, an unexpected image forming status such as damage on the sheet and production of paper dust can be reduced or eliminated.

Figure 13:
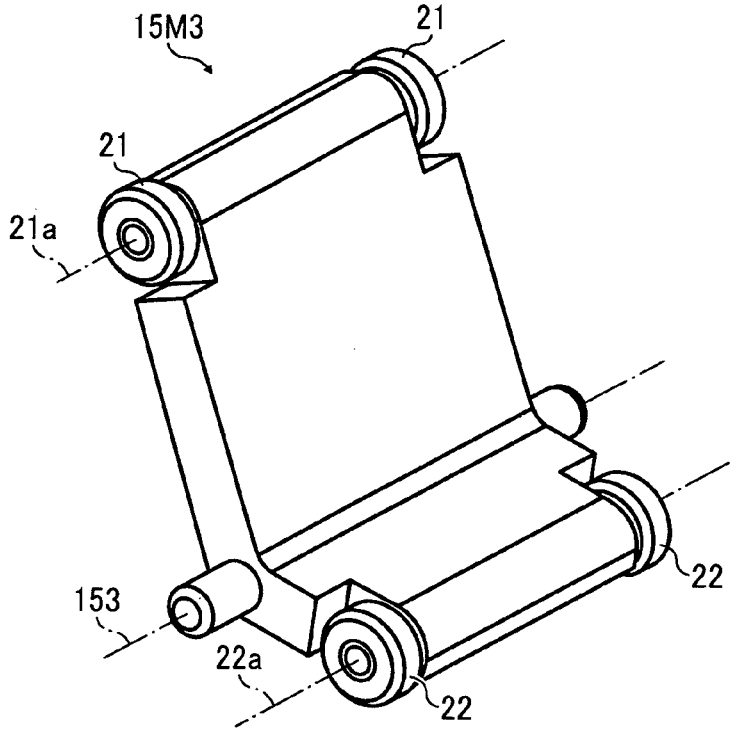
FIG. 13 is a perspective view of the contact member of FIG. 12.

FIG. 13 illustrates a detailed configuration of the contact member 15M3 with the transfer rollers 21 and 22. The transfer rollers 21 and 22 are rotatably provided with the rotation axes 21*a* and 22*a* formed by part of the contact member 15M3.

Third Embodiment

Figure 14:
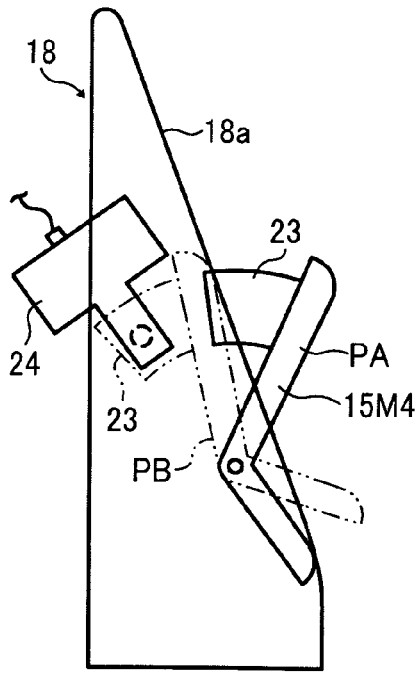
FIG. 14 is a diagram illustrating a contact member according to a third embodiment.

FIG. 14 illustrates a schematic configuration of the guiding member 18 to explain yet another embodiment, which is hereinafter referred to as a third embodiment.

As shown in FIG. 14, the guiding member 18 includes a contact member 15M4 and a photointerrupter 24 mounted on the guiding member 18. The photointerrupter 24 serves as a detector to detect the position of the contact member 15M4. That is, when the position of the contact member 15M4 is changed from the position PA to the position PB, a feeler 23 that is integrally mounted on the contact member 15M4 switches the status of the light axis of the photointerrupter 24 between a light blocking state and a light passing state. Consequently, the photointerrupter 24 determines the position of the contact member 15M4 according to ON or OFF of the electric signals transmitted from the photointerrupter 24.

With this configuration, the photointerrupter 24 can detect the position of the sheet S while the sheet S is passing over the contact member 15M4. Consequently, when a paper jam occurs, for example, the photointerrupter 24 can detect the position of the jammed sheet, measure the size of the jammed sheet, and determine the transport timing of the leading edge of the sheet S. By so doing, the photointerrupter 24 can effectively perform as a detector, which is conventionally disposed in the vicinity of the transfer roller. Consequently, the photointerrupter 24 can be connected to a drive control unit for image forming onto the sheet S and sheet reversing to a duplex sheet transport path.

Fourth Embodiment

Figure 15:
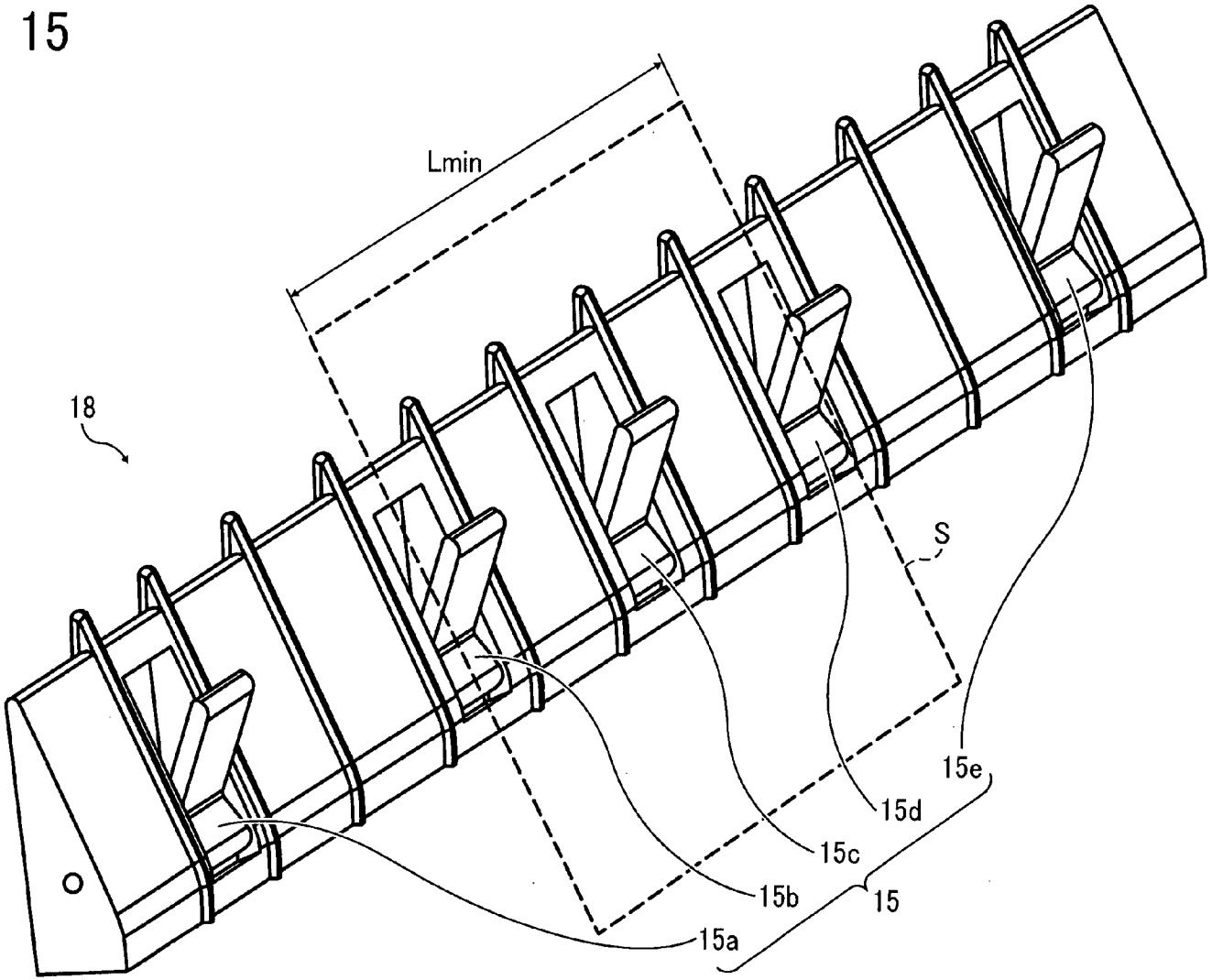
FIG. 15 is a diagram illustrating multiple contact members attached to a guide member.

FIG. 15 illustrates a schematic configuration of the guide member 18 with the contact member 15 including multiple contact sub-members 15*a* through 15*e*, as a fourth embodiment.

As illustrated in FIG. 15, the guide member 18 includes five contact sub-members 15*a*, 15*b*, 15*c*, 15*d*, and 15*e* across a width direction of the sheet S.

When the width of the sheet S is large, it is likely that one contact member 15 cannot sufficiently reduce the occurrence of flapping noise caused by the trailing edge of the sheet S. However, by disposing the multiple contact sub-members 15 (i.e., the contact sub-members 15*a* through 15*e*) across the width direction of the guiding face 18*a* of the guide member 18, the occurrence of flapping noise and paper jam can be reduced more effectively compared to with one contact sub-member 15. Further, by providing the multiple contact sub-members 15 along a line perpendicular to the sheet transport direction X of the sheet S, the transfer load for the leading edge of the sheet S may be provided and distributed to the multiple contact sub-members 15 at the same time, the sheet S can be free from skew.

Further, for reducing the number of the contact members 15, if the image forming apparatus employs multiple paper sizes, the contact sub-member(s) can be provided only within the width of the minimum-size paper. Specifically, if a length Lmin shown in FIG. 15 corresponds to the width of the minimum-size paper, at least one of the contact sub-members 15*b*, 15*c*, and 15*d*, which are located within the length Lmin can be arranged on the guide member 18. Further, a sheet transport mechanism may set a basic position for sheet transport at the centerline or one side of the centerline in the width of the sheet S or a direction perpendicular to the sheet transport path. If the basic position is set at the centerline in the width of the sheet, only the contact sub-member 15*c* can be provided. By contrast, if the basic position is set at one side of the centerline in the width of the sheet, the contact sub-members 15*a* and 15*e* can be arranged. By so doing, all size of paper can contact the contact sub-member(s).

Figure 16:
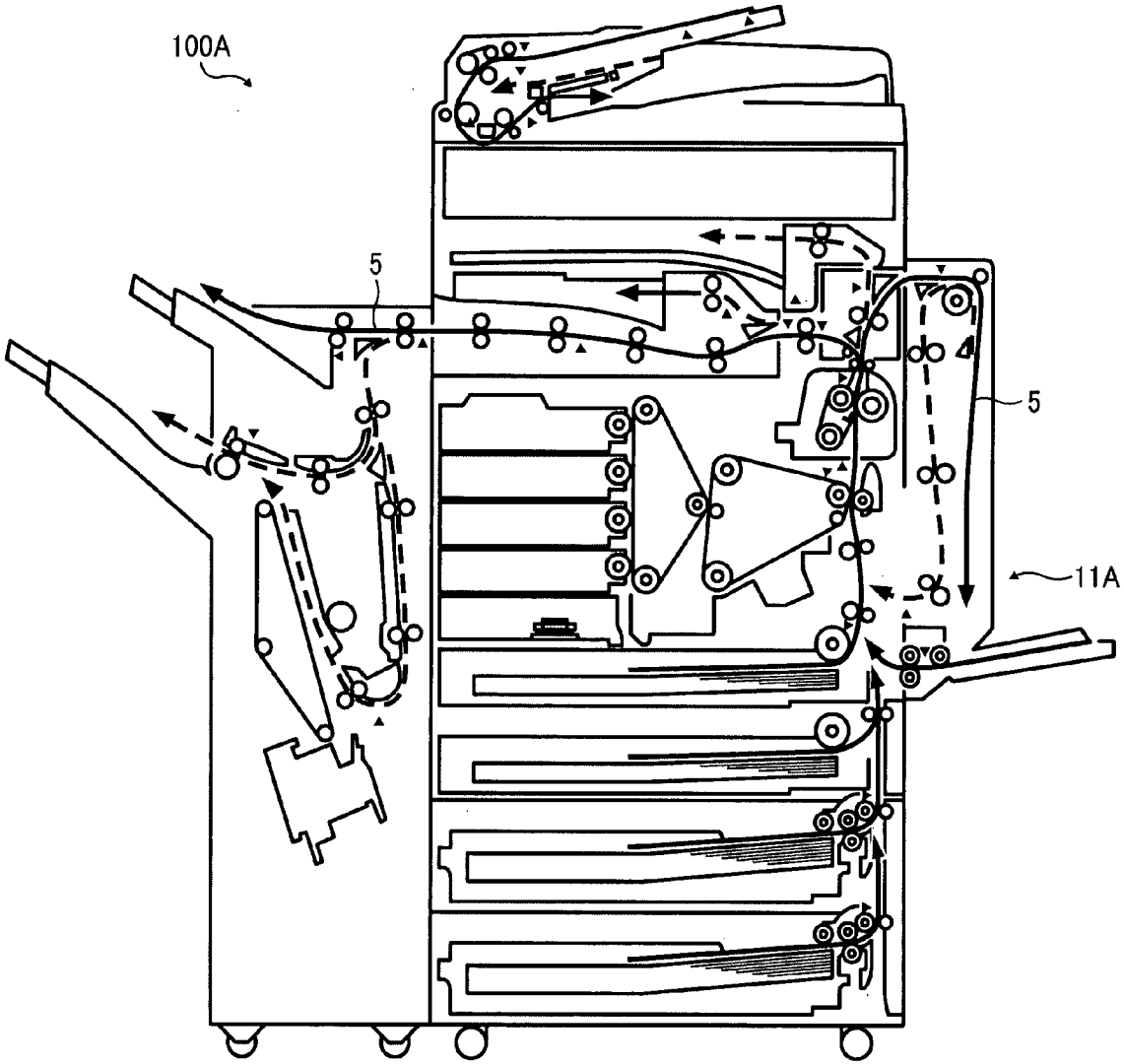
FIG. 16 is a perspective view illustrating an example of an image forming apparatus that performs operations of embodiments.

The sheet transport mechanism having the above-described features is useful and applicable to almost all types of image forming apparatuses for preventing noise caused when the trailing edge of a sheet during a transporting operation passes over a step formed between parts defining a sheet transport path. Further, the sheet transport mechanism can retain a contact member included therein in a stable position without providing any additional part. The sheet transport mechanism can also be used for sheet transport paths in large-sized image forming apparatuses such as an image forming apparatus 100A illustrated in FIG. 16. The image forming apparatus 100A may include units and components similar to the units and components used in the image forming apparatus 100.

As described above, the image forming apparatus 100 includes the sheet transport path having a curved portion. Such a curved sheet transport path includes a step (or steps) between an upstream part member and a downstream part member forming the curved portion. The downstream part member is recessed from the upstream part member in the sheet transport path 5. When the sheet S passes the step, a flapping noise is produced by striking or hitting the downstream part member at the step with the trailing edge of the sheet. To prevent the flapping noise, the image forming apparatus 100 includes the contact member 15 that has the first contact portion 151 and the second contact portion 152. The contact member 15 is mounted on the guide member 18 that is a downstream part member disposed downstream from the step in the sheet conveyance path 5 in the sheet transport direction. When the leading edge of the sheet S contacts the first contact portion 151 of the contact member 15, the contact member 15 changes the position from the position PA to the position PB to cause the first contact portion 151 to retreat from the sheet transport path 5. The contact member 15 is configured that, as the first contact portion 151 retreats from the sheet transport path, the second contact portion 152 advances toward the sheet transport path 5. Accordingly, this configuration can reduce the flapping noise caused when the trailing edge of the sheet S strikes the downstream section of the sheet conveyance path by its own restorative force after passing the step.

Alternative to the contact member 15 formed by one member including two contact portions (i.e., the first contact portion 151 and the second contact portion 152), the sheet transport mechanism 11 may include the contact member 15' that is formed by two or more portions (i.e., the first contact portion 15*c* and the second contact portion 15*d*) as shown in FIG. 3. That is, the contact member 15' illustrated in FIG. 3 includes the first contact portion 15*c* as a trigger and the second contact portion 15*d*. The movement of the first contact portion 15*c* triggers to cause the second contact portion 15*d* to advance toward the sheet transport path 5, as shown in FIG. 3.

Accordingly, the sheet transport mechanism 11 includes the sheet feeding rollers 1*a*, 1*b*, and 1*c* that serve as the first sheet transport member to feed and convey the sheet S, the pair of registration rollers 2 that serves as the second sheet transport member disposed downstream from the first sheet transport member to forward the sheet S in the sheet transport direction, and the sheet transport path 5 defined by the first sheet transport member and the second sheet transport member and having the curved portion from the first sheet transport member to the second sheet transport member. The sheet transport path 5 includes the step at which the sheet transport path 5 can be divided into two sections, which are the upstream section and the downstream section, in the sheet transport direction. At the step, the downstream section of the sheet transport path 5 is recessed from the upstream section thereof.

The downstream section of the sheet transport path 5 is provided with the guide member 18 that includes the contact member 15 to contact the sheet S when the sheet S is conveyed. The contact member 15 includes the first contact portion 151 and the second contact portion 152. When the sheet S is conveyed to the downstream section of the sheet transport path 5, the leading edge of the sheet S contacts the first contact portion 151 to move the first contact portion 151 in the direction to retreat from the sheet transport path 5. This movement of the first contact portion 151 triggers the second contact portion 152 to advance toward the sheet transport path 5 to contact the surface of the sheet S.

With this configuration, the contact member can prevent the occurrence of flapping noise caused by the trailing edge of the sheet when the downstream section of the guiding face in the curved sheet conveyance path is recessed from the sheet transport path.

Further, when the step 19 is formed by dividing a unit or component in the middle of the sheet transport path 5, the sheet transport path 5 of the sheet transport mechanism 11 is divided into the upstream section and the downstream section at the parting point PP in the direction intersecting the sheet transport direction X. The downstream section from the parting point in the sheet transport direction X is more recessed from the sheet transport path 5 than the upstream section from the parting point in the sheet transport direction X. This configuration can separate the curved sheet transport path 5 into two or more units.

Further, when the step 19 is formed at a meeting point of two different sheet transport paths in the middle of the sheet transport path 5, the sheet transport path 5 of the sheet transport mechanism 11 includes the meeting point where the sheet transport path 5 meets at least one different sheet transport path. The downstream section from the meeting point in the sheet transport direction X is more recessed from the sheet transport path 5 than the upstream section from the meeting point in the sheet transport direction X. This configuration can prevent production of flapping noise caused when the trailing edge of the sheet S strikes the sheet transport path at the meeting point where two sheet conveyance paths meet.

Further, the sheet transport mechanism 11 includes the contact member 15 formed by integrally providing the first contact portion 151 and the second contact portion 152 thereto. The contact member 15 further includes the rotation center 153 that serves as a point of rotation. The rotation center 153 is located at a position that is farther recessed from the sheet transport path 5 than the downstream section of the sheet transport path 5. In addition, the rotation center 153 is located upstream from the first contact portion 151 and downstream from the second contact portion 152 in the sheet transport direction X. This configuration can rotate the contact member 15 about the rotation center 153 to prevent flapping noise by using one unit or component.

Further, for regulating the movement of the contact member 15 in the sheet transport mechanism 11, when the leading edge of the sheet S contacts the first contact portion 151, the first contact portion 151 of the contact member 15 rotates about the rotation center 153 toward the downstream section in the sheet transport direction X. As the first contact portion 151 rotates as described above, the second contact portion 152 of the contact member 15 rotates about the rotation center 153 toward the downstream section in the sheet transport direction X, resulting in that the second contact portion 152 advances toward the sheet transport path 5 to contact at least the surface of the sheet S.

This configuration can cause the contact member 15 to move in a predetermined direction to cause the second contact portion 152 to contact the surface of the sheet S so as to prevent the occurrence of flapping noise.

The contact member 15 of the image forming apparatus 100 includes a substantially L-shaped curved portion to prevent the occurrence of flapping noise. The contact member 15 rotates about the rotation center 153 arranged at the substantially L-shaped curved portion thereof.

The angle θ formed between the first contacting portion 151 and the second contacting portion 152 with the rotation center 153 therebetween is in a range of 90 degrees$\leqq\theta<$180 degrees. By so doing, the occurrence of flapping noise can be prevented more effectively.

The contact member has the structure in which the straight line joining the first contacting portion 151 and the rotation center 153 is longer than the straight line joining the second contacting portion 152 and the rotation center 153, thereby effectively preventing the occurrence of flapping noise even when conveying a rigid sheet having a high repulsion force.

The sheet transport mechanism includes the elastic member 20 serving as the biasing member to urge the contact member 15 to maintain the second contact portion 152 at the position that is recessed from the sheet transport path 5. The elastic member 20 can keep the contact member 15 in the standby position, i.e., the position PA, and therefore can prevent the occurrence of paper jam.

Even without the elastic member 20, the contact member 15 can be maintained at a position that is recessed from the sheet transport path 5 by the weight thereof with a torque for rotating the contact member 15 about the rotation center 153. Since the center of gravity of the contact member 15 with respect to the rotation center 153 generally tends to shift in the downward direction, the torque for the contact member 15 is constantly generated in the downward direction. Therefore, the contact member 15 can maintain the position PA without using the elastic member 20.

The second contact portion 152 of the contact member 15 retreats from the sheet transport path 5 by rotating about the rotation center 153 by the weight of the contact member 15. Accordingly, the second contact portion 152 can be maintained in the standby position, i.e., the position PA, without being urged by any additional biasing member, resulting in a reduction in costs.

The coefficients of friction of at least the first contact portion 151 and the second contact portion 152 of the contact member 15 are smaller than the coefficient of friction of the surface of the sheet transport path 5. Consequently, the transfer load is reduced, thereby preventing side effects such as paper jam.

The contact member 15 employs at least one roller, i.e., the transfer rollers 21 and 22, for at least one of the first contact portion 151 and the second contact portion 152. With the transfer roller, i.e., the transfer rollers 21 and 22, attached to the contact member 15 can further reduce the coefficient of friction, prevent abrasion due to the friction caused while the sheet S is being conveyed, and prevent production of paper dust.

The image forming apparatus 100 includes the photointerrupter 24 as a detector to detect a change in position of the contact member 15. The detection performed by the photointerrupter 24 can inform the location of the sheet and the sheet size. By connecting with a drive control unit, the detection results obtained by the photointerrupter 24 can be used for image forming and paper jam detection.

The multiple contact sub-members 15*a* through 15*e* are arrayed on the guide member 18 in a direction perpendicular to the sheet transport direction X. Accordingly, the flapping noise can be prevented even if sheets having different width sizes are used in the image forming apparatus 100.

At least one of the multiple contact sub-members 15*a* through 15*e* is disposed at a position at which the minimum-size target sheets having various sizes contacts the at least one of the multiple contact sub-members 15*a* through 15*e*. Accordingly, the flapping noise can be prevented even if sheets having different width sizes are used in the image forming apparatus 100.

Some image forming apparatuses employ a center registration guiding system with which a sheet is conveyed based on the center registration. In such image forming apparatuses, the contact member 15 can be disposed at substantially the centerline of the sheet transport path 5 in a direction perpendicular to the sheet transport direction X. Accordingly, the flapping noise can be prevented even if the trailing edge of sheets having any width size are used in the image forming apparatus 100.

Some image forming apparatuses employ a side registration guiding system with which a sheet is conveyed with one side edge of thereof engaged to one side of the sheet transport path 5. In such image forming apparatus, one contact member 15 can be disposed to one side of the centerline of the sheet transport path 5 in a direction perpendicular to the sheet transport direction X, thereby preventing the occurrence of flapping noise even if the trailing edge of sheets having any width size are used in the image forming apparatus 100.

The sheet transport mechanism 11 according to any embodiment of the present patent application can be applied to various types of image forming apparatuses that have a curved sheet transport path and an effect to prevent production of flapping noise caused when the trailing edge of a sheet strikes the sheet transport path 5 at the step can be expected.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A sheet transport mechanism, comprising:

a curved path configured to convey sheets in a sheet transport direction, the curved path including an upstream section having first and second branches meeting to form a downstream section having a sheet transport path, the sheet transport path being a single path on the curved path downstream of the first and second branches;

a first sheet transport member including a first roller configured to feed and convey the sheets along the first branch in the sheet transport direction and a second roller configured to feed and convey the sheets along the second branch in the sheet transport direction;

a second sheet transport member disposed downstream along the transport path to advance the sheets in the sheet transport direction;

a contact member disposed on a first sidewall of the sheet transport path to contact sheets advancing downstream from the first and second branches, the contact member configured to movably rotate between a first position and a second position, the contact member maintaining the first position when not in contact with the sheets, the contact member including, a first contact portion, configured to retreat from the sheet transport path as the contact member rotates toward the second position when a leading edge of one of the sheets makes contact with the first contact portion as the sheets move in the sheet transport direction, a second contact portion connected to the first contact portion, the second contact portion configured to avoid the sheet transport path when the contact member is in the first position, and enter the sheet transport path only when the contact member rotates toward the second position to advance the sheets, and a feeler connected to at least one of the first contact portion and the second contact portion; and a detector to detect a change in position of the feeler as the contact member rotates between the first position and the second position, wherein the contact member is disposed at a position further recessed from the sheet transport path than the downstream section of the sheet transport path, and the sheet transport mechanism includes a point of rotation disposed upstream from the first contact portion and downstream from the second contact portion in the sheet transport direction about which the first contact portion and the second contact portion rotate.

2. The sheet transport mechanism according to claim 1, wherein, when the first contact portion contacts the leading edge of the sheet, as the first contact portion rotates about the point of rotation toward the downstream section in the sheet transport direction, the second contact portion rotates about the point of rotation toward the downstream section in the sheet transport direction and advances toward the sheet transport path to contact a surface of the sheet.

3. The sheet transport mechanism according to claim 1, wherein the contact member includes a substantially L-shaped curved portion, the point of rotation is arranged at the substantially L-shaped curved portion.

4. The sheet transport mechanism according to claim 1, wherein an angle formed between the first contact portion and the second contact portion with the point of rotation therebetween is in a range of 90 degrees$\leqq\theta<$180 degrees.

5. The sheet transport mechanism according to claim 1, wherein the contact member has a structure in which a straight line joining the first contact portion and the point of rotation is longer than a straight line joining the second contact portion and the point of rotation.

6. The sheet transport mechanism according to claim 1, further comprising a biasing member to urge the contact member to maintain the second contact portion at a position that is recessed from the sheet transport path.

7. The sheet transport mechanism according to claim 1, wherein the second contact portion of the contact member retreats from the sheet transport path by rotating about the point of rotation by the weight of the contact member.

8. The sheet transport mechanism according to claim 1, wherein the weight thereof with a torque for rotating the contact member about the point of rotation maintains the contact member at a position that is recessed from the sheet transport path.

9. The sheet transport mechanism according to claim 1, wherein the contact member has a coefficient of friction of at least the first contact portion and the second contact portion smaller than a coefficient of friction of the surface of the sheet transport path.

10. The sheet transport mechanism according to claim 1, wherein the contact member further comprises at least one roller disposed on at least one of the first contact portion and the second contact portion that rotates in a direction of at least one of the first contact portion and the second contact portion.

11. The sheet transport mechanism according to claim 1, wherein the contact member comprises multiple contact sub-members arrayed in a direction perpendicular to the sheet transport direction.

12. The sheet transport mechanism according to claim 11, wherein at least one of the multiple contact sub-members is disposed at a position at which a minimum-size target sheet contacts the at least one of the multiple contact sub-members.

13. The sheet transport mechanism according to claim 1, wherein the contact member is disposed at substantially a centerline of the sheet transport path in a direction perpendicular to the sheet transport direction.

14. The sheet transport mechanism according to claim 1, wherein the contact member is disposed to one side of the centerline of the sheet transport path in a direction perpendicular to the sheet transport direction.

15. An image forming apparatus, comprising:

an image forming mechanism to form an image; and the sheet transport mechanism according to claim 1.

16. A sheet transport mechanism, comprising:

a curved path configured to convey sheets in a sheet transport direction, the curved path including first and second branches meeting to form a sheet transport path that is a single path, the first and second branches each including a first transport member configured to advance the sheets in the sheet transport direction and the curved path including a second transport member configured to advance the sheets in the sheet transport direction;

a contact member disposed on a first sidewall of the sheet transport path to contact sheets advancing in the sheet transport direction from the first and second branches to the sheet transport path, the contact member configured to movably rotate between a first position and a second position, the contact member maintaining the first position when not in contact with the sheets, the contact member including, a first contact portion, configured to retreat completely from the sheet transport path as the contact member rotates toward the second position when a leading edge of one of the sheets makes contact with the first contact portion as the sheet moves in the sheet transport direction, a second contact portion connected to the first contact portion, the second contact portion configured to avoid the sheet transport path when the contact member is in the first position, and enter the sheet transport path, as the contact member rotates toward the second position to advance the sheets in the sheet transport direction, and a feeler connected to at least one of the first contact portion and the second contact portion; and a detector to detect a change in position of the feeler as the contact member rotates between the first position and the second position, wherein the contact member is disposed at a position further recessed from the sheet transport path than a downstream section of the sheet transport path, and the sheet transport mechanism includes a point of rotation disposed upstream from the first contact portion and downstream from the second contact portion in the sheet transport direction about which the first contact portion and the second contact portion rotate.

* * * * *